US005785811A

United States Patent [19]

Pokora et al.

[11] Patent Number: 5,785,811

[45] Date of Patent: Jul. 28, 1998

[54] PROCESS FOR TREATING LIGNOCELLULOSIC MATERIAL WITH SOYBEAN PEROXIDASE IN THE PRESENCE OF PEROXIDE

[75] Inventors: Alexander R. Pokora, Pickerington; Mark A. Johnson, Chillicothe, both of Ohio

[73] Assignee: The Mead Corporation, Dayton, Ohio

[21] Appl. No.: 973,655

[22] Filed: Nov. 9, 1992

[51] Int. Cl.[6] ..... D21H 25/02

[52] U.S. Cl. ..... 162/65; 162/72; 162/78; 162/88; 435/277; 435/278

[58] Field of Search ..... 162/72, 78, 65, 162/88, 89; 435/277, 278, 156, 190, 192

[56] References Cited

U.S. PATENT DOCUMENTS

| | | | |
|---|---|---|---|
| 4,687,741 | 8/1987 | Farrell et al. | 435/189 |
| 4,690,895 | 9/1987 | Farrell et al. | 435/162 |
| 4,830,708 | 5/1989 | Paice et al. | 162/435 |
| 5,147,793 | 9/1992 | Cyrus, Jr et al. | 162/72 |

FOREIGN PATENT DOCUMENTS

| | | | |
|---|---|---|---|
| 2019411 | 6/1990 | Canada | 162/72 |
| 0395792 | 11/1990 | European Pat. Off. | 162/72 |

*Primary Examiner*—Steven Alvo

*Attorney, Agent, or Firm*—Thompson Hine & Flory LLP

[57] ABSTRACT

Wood pulps are bleached and/or delignified using soybean peroxidase. A protease, xylanase, ligninase, pectin esterase, pectin lyase or manganese peroxidase may also be used simultaneously or as a pretreatment or posttreatment.

12 Claims, No Drawings

PROCESS FOR TREATING LIGNOCELLULOSIC MATERIAL WITH SOYBEAN PEROXIDASE IN THE PRESENCE OF PEROXIDE

The present invention relates to bleaching wood pulps and, more particularly, to bleaching kraft pulps.

Wood pulps contain lignin which must be removed in order to obtain a pulp of high brightness and brightness stability. A number of chemical processes and bleaching techniques have been developed in the paper industry to delignify and bleach wood pulps. One of the most common processes is chlorination or chlorination with chlorine dioxide present. This process is disadvantageous because it produces effluents containing chlorinated organic compounds (AOX) which are toxic.

Oxygen delignification and bleaching processes have been used to avoid some of the disadvantages of the aforementioned chlorination processes. In one particularly successful process the pulp is treated with a combination of oxygen and hydrogen peroxide. While this process is not accompanied by AOX production, the pulp yield and properties are generally considered less desirable than those obtained with chlorine-based processes. Hydrogen peroxide has been shown to delignify sulfite pulps satisfactorily, but when used alone it is a relatively ineffective means of bleaching kraft pulp. When used in sequences with chlorine-containing bleaching agents, however, peroxide contributes significantly to delignification, pulp brightness and brightness stability.

A number of researchers have investigated enzymatic processes for bleaching wood pulps using isolated enzymes and microbial cultures. Canadian Patent No. 758,488 to Jenness and Cooper describes a method of treating paper pulp with enzymes to improve the quality of the paper, although no mention is made of bleaching. USSR Pat. No. 321,563 to Grinberg et al. and U.S. Pat. No. 3,962,033 to Eriksson et al. describe methods in which enzymes and microorganisms are respectively used to lower energy requirements during pulp refining. German Patent No. 3,110,117 to Eisenstein et al. describes a somewhat similar process to that of Eriksson et al. for pulping lignocellulosic material with white rot fungi, e.g. *Pleurotus ostreatus*. USSR Pat No. 507,677 describes pretreatment of cellulosic raw material with a culture filtrate from wood decaying fungi to reduce sulphite pulping time and improve paper making properties. Swedish Patent No. 412,422 to Hartler describes a method of biological treatment of separated fibers from a first stage refining process which results in lower energy requirements in subsequent stages. Japanese Patent No. 10,240/82 to Oji Paper Company discloses mixing equal weights of pulp and mycelia of the mold *Rhizopus javanicus* to obtain paper. Canadian Patent No. 1,203,188 to Naylor et al. discloses using a quinoid additive produced by a microorganism as a catalyst in the alkaline pulping of lignocellulose. French Patent No. 2,557,894 to Comatat et al. discloses improving chemical pulp fibrillation by application of the enzyme xylanase.

U.S. Pat. No. 4,690,895 discloses a process for bleaching kraft pulp with ligninases and, more particularly, a ligninase identified as rLDM TM which is isolated from a strain of white rot fungus obtained by UV mutagenesis. The fungus is designated SC 26 having accession number NRRL 15978.

Lignin degradation through the use of microorganisms has been studied, especially using white rot fungi such as *Pharerochaete chrysosporium*. The mechanism with *Phanerochaete chrysosporium* is now believed to include the rapid colonization of lignocellulosic fibers by hyphae through the lumens, followed by simultaneous degradation and removal of major wood components by extracellular biological reagents. A hydrogen peroxide dependent lignin peroxidase has been implicated as one enzyme involved in lignin degradation especially in the degradation of model compounds lignin. Other redox enzymes are probably also required for total mineralization. Bleaching has been found to be impractically slow using fungal cultures.

DESCRIPTION OF THE INVENTION

In accordance with the present invention, wood pulps are bleached and/or delignified using soybean peroxidase. It has been found that soybean peroxidase is a cost-effective, thermally and chemically stable, highly reactive enzyme. Soybean peroxidase is obtained by extraction from soybean hulls as described in U.S. application Ser. No. 07/599,584 filed Oct. 18, 1990 now U.S. Pat. No. 5,147,793. The enzyme is stable over a pH range of about 1.5 to 13 and up to about 70° C. The enzyme exhibits a higher redox potential than horseradish peroxidase. These properties make soybean peroxidase highly desirable for use in pulp bleaching. The higher redox potential of the enzyme is shown in table 1.

REDOX POTENTIAL COMPARISON BETWEEN SBP AND HRP

| Substrate (λmax) | $E_{1/2}$ (V) | HRP* |
|---|---|---|
| SBP* | | |
| pentamethoxy-(300 nm) 8.76 | 1.07 | 2.50 |
| 1,2,3,5-tetramethoxy-(295 nm) 3.02 | 1.09 | 0.30 |
| 1,2,4-trimethoxy-(450 nm) 9.23 | 1.12 | 1.64 |
| hexamethoxy-(425 nm) 0.22 | 1.24 | 0 |
| 1,4-dimethoxy-(315 nm) 0.072** | 1.34 | 0 |

*All values in ΔAbs/(mg enzyme-min)
**Curve of ΔAbs/time slopes upward as reaction proceeds Suitable pulps for the practice of invention include hardwood, softwood and other lignocellulosic pulps. By way of example, mechanical, themomechanical, chemimechanical, sulfite, kraft, soda and modified sulfite pulps may be used.

The treatment can be carried out in any vessel of the desired size with provision for mixing and controlling the temperature of the contents. Process conditions can be varied depending upon the results desired and the cost efficiencies. The order of addition of the reactants is not critical. The basic reaction mixture comprises pulp in water at a pH appropriate for the enzyme or enzyme mixture used. The reaction mixture may range from about 0.01 to 20% in consistency. The peroxidase is reacted in a ratio of about 1.000 to 0.01 units per gram O.D. (oven-dried) pulp. One unit of peroxidase is defined as that amount which will produce a change of 12 absorbance units measured at a 1 cm path length in one minute at 420 nm when added to a solution containing 100 mM potassium phosphate, 44 mM pyrogallol and 8 mM hydrogen peroxide and having a pH of 6 (Sigma Chemical Peroxidase Bulletin). Peroxide, which is preferably hydrogen peroxide, may be applied to the pulp as a solution in water in an amount of about 0.03 to 3 mg peroxide per 1 gram O.D. pulp. The reaction mixture is incubated at 20° to 95° C. for about 0.1 to 6 hours. Those skilled in the art will be able to readily optimize reaction conditions without undue experimentation.

In accordance with one aspect of the invention, a protease, xylanase, ligninase, pectin esterase, pectin lyase, or manganese peroxidase may also be used simultaneously or as a pretreatment or posttreatment. Generally, these enzymes appear to make the fibers more penetrable. For reaction of xylanase, reference can be made to International Application W091/05908. For reaction of ligninase, see European Patent Application 90810681.8. For reaction of a protease, see copending and commonly assigned U.S. application Ser. No. 07/800.459. The protease can be either papain or a subtilisin.

Treatment of pulp in accordance with the invention may be coupled with any delignification or bleaching process to enhance the efficacy of those processes. Among other processes that may be coupled with that of the invention in making paper or board are oxygen delignification, hydrogen peroxide extraction and bleaching, chlorine dioxide bleaching, chlorine and chlorine dioxide bleaching, etc. Treatment with soybean peroxidase may be carried out before, after or simultaneously with these processes. Any sequence including at least one stage in which chips or pulps are incubated with soybean peroxidase are useful herein. The treatment may be positioned to advantage at any stage of the process.

It is generally desirable to pretreat pulps to remove materials which may be deposited on the fibers and which may exhaust the enzyme. Many of these materials are alkaline soluble and, hence, it is desirable to wash the pulp with a sodium hydroxide solution (pH about 11 to 14) prior to the treatment. The alkaline pretreatment is generally carried out at 10° to 80° C. using about 5 to 200 parts alkali per 100 parts dry pulp. Another effective pretreatment is carried out at an alkaline pH and using about 50 to 5,000 cellulase units per 100 grams pulp or chips. Where the pulp is manufactured under alkaline conditions, this may not be necessary. For example, alkaline pretreatment of kraft pulps is not necessary. Treatment with a surfactant or detergent may be used to enhance penetration of the enzyme into the fiber pores and to enhance washing of impurities and interfering substances. Pores may be opened by cellulase or pectinase pretreatments. Also treatment with chelators to remove metals may enhance penetration.

Having described the invention in detail and by reference to preferred embodiments thereof, it will be apparent that modifications and variations are possible without departing from the scope of the invention defined in the appended claims.

What is claimed is:

1. A process which comprises treating a lignocellulosic pulp with soybean peroxidase in the presence of a peroxide, and removing lignin from said pulp.

2. The process of claim 1 wherein said treatment is carried out at a temperature of about 20° to 95° C.

3. The process of claim 2 wherein said pulp is pretreated to enhance the infiltration of said pulp by said peroxidase enzyme.

4. The process of claim 3 wherein said pretreatment includes treating said pulp with sodium hydroxide solution.

5. The process of claim 3 wherein said pretreatment includes treating said pulps with a cellulase enzyme solution.

6. The process of claim 1 wherein said pretreatment includes treating said pulp with a xylanase enzyme.

7. The process of claim 1 wherein said process includes the additional step of treating said pulp with a protease enzyme.

8. The process of claim 7 wherein said protease is papain or a subtilisin.

9. The process of claim 1 wherein said pulp is a mechanical pulp.

10. The process of claim 1 wherein said process further comprises delignification and/or bleaching of said pulp.

11. The process of claim 10 wherein said delignification or bleaching process is selected from the group consisting of oxygen delignification or bleaching, hydrogen peroxide extraction or bleaching, and chlorine or chlorine dioxide bleaching.

12. The process of claim 11 wherein said delignification or bleaching process is peroxide enhanced oxygen delignification.

* * * * *